US005647427A

United States Patent [19]

Collins et al.

[11] Patent Number: 5,647,427

[45] Date of Patent: Jul. 15, 1997

[54] NON-FERROUS METAL CASTING MOLD TABLE SYSTEM

[75] Inventors: Richard J. Collins; Loren Keith Bodeau, both of Spokane, Wash.

[73] Assignee: Wagstaff, Inc., Spokane, Wash.

[21] Appl. No.: 515,699

[22] Filed: Aug. 15, 1995

[51] Int. Cl.[6] ..... B22D 11/00; B22D 11/124

[52] U.S. Cl. ..... 164/459; 164/418; 164/485; 164/443

[58] Field of Search ..... 164/137, 339–341, 164/444, 487, 459, 418, 485, 443

[56] References Cited

U.S. PATENT DOCUMENTS 5,320,159 6/1994 Schneider et al. ..... 164/444

5,323,841 6/1994 Wagstaff et al. ..... 164/444

*Primary Examiner*—Joseph J. Hail, III

*Assistant Examiner*—I.-H. Lin

*Attorney, Agent, or Firm*—Wells, St. John, Roberts, Gregory & Matkin, P.S.

[57] ABSTRACT

Disclosed is a system for providing a modular mold table for use in conjunction with a vertical non-ferrous metal casting apparatus. A plurality of longitudinal headers with a coolant passageway and transverse headers with a coolant passageway provide the mold table. A centralized water screen is provided to screen undesired inclusions in the coolant. Pre-cast modules which contain the mold cavities and other interconnections for coolant, oil and gas are operatively connected to the longitudinal headers and can be added or removed in building block fashion. Also disclosed is an oil delivery system and a gas delivery system wherein longitudinally oriented oil and gas passageways are included within the longitudinal headers.

19 Claims, 7 Drawing Sheets

NON-FERROUS METAL CASTING MOLD TABLE SYSTEM

TECHNICAL FIELD

The present invention relates to an apparatus and process for a non-ferrous metal casting mold table for use in the casting of non-ferrous metal ingots and billets.

BACKGROUND OF THE INVENTION

Non-ferrous metal ingots and billets are formed by a casting process, which utilizes a vertically oriented mold situated above a large casting pit beneath the floor level of the casting facility. The lower component of the vertical casting mold is a starting block mounted on starting block pedestals. When the casting process begins, the starting blocks are in their upward-most position and in the molds. As molten non-ferrous metal is poured into the mold and cooled, the starting block is slowly lowered at a pre-determined rate by a hydraulic cylinder or other device. As the starting block is lowered, solidified non-ferrous metal or aluminum emerges from the bottom of the mold and ingots or billets are formed.

While the invention applies to casting of non-ferrous metals, including aluminum, brass, lead, zinc, magnesium, copper etc., the examples given and preferred embodiment disclosed are for aluminum, and therefore the term aluminum will be used throughout for consistency even though the invention applies more generally to non-ferrous metals.

While there are numerous ways to achieve and configure a vertical casting arrangement, FIG. 1 illustrates one example. In FIG. 1, the vertical casting of aluminum generally occurs beneath the elevation level of the factory floor in a casting pit. Directly beneath the casting pit floor 1*a* is a caisson 3, in which the hydraulic cylinder barrel 2 for the hydraulic cylinder is placed.

As shown in FIG. 1, the components of the lower portion of a typical vertical aluminum casting apparatus, shown within a casting pit 1 and a caisson 3, are a hydraulic cylinder barrel 2, a ram 6, a mounting base housing 5, a platen 7 and a starting block base 8, all shown at elevations below the casting facility floor 4.

The mounting base housing 5 is mounted to the floor 1*a* of the casting pit 1, below which is the caisson 3. The caisson 3 is defined by its side walls 3*b* and its floor 3*a*.

A typical mold table assembly 10 is also shown in FIG. 1, which can be tilted as shown by hydraulic cylinder 11 pushing mold table tilt arm 10*a* such that it pivots about point 12 and thereby raises and rotates the main casting frame assembly, as shown in FIG. 1. There are also mold table carriages which allow the mold table assemblies to be moved to and from the casting position above the casting pit.

FIG. 1 further shows the platen 7 and starting block base 8 partially descended into the casting pit 1 with billet 13 being partially formed. Billet 13 is on starting block 14, which is mounted on pedestal 15. While the term starting block is used for item 14, it should be noted that the terms bottom block and starting head are also used in the industry to refer to item 14, bottom block typically used when an ingot is being cast and starting head when a billet is being cast.

While the starting block base 8 in FIG. 1 only shows one starting block 14 and pedestal 15, there are typically several of each mounted on each starting block base, which simultaneously cast billets or ingots as the starting block is lowered during the casting process.

When hydraulic fluid is introduced into the hydraulic cylinder at sufficient pressure, the ram 6, and consequently the starting block base 8, are raised to the desired elevation start level for the casting process, which is when the starting blocks are within the mold table assembly 10.

The lowering of the starting block base 8 is accomplished by metering the hydraulic fluid from the cylinder at a pre-determined rate, thereby lowering the ram 6 and consequently the starting blocks at a pre-determined and controlled rate. The mold is controllably cooled during the process to assist in the solidification of the emerging ingots or billets, typically using water cooling means.

The vertical semi-continuous casting process generally utilizes a mold table which contains and distributes cooling water to the individual molds. In an effort to maximize the number of billets which can be cast during any one lowering of the hydraulic cylinder, mold tables generally consist of a single or unitized spray box which delivers water to each mold from a common cavity.

There are numerous mold and pour technologies that fit into these mold tables. Some are generally referred to as "hot top" technology, while others are more conventional pour technologies that use floats and downspouts, both of which are known to those of ordinary skill in the art. The hot top technology generally includes a refractory system and molten metal trough system located on top of the mold table, whereas the conventional pour technology involves suspending the source of molten metal above the mold table and the utilization of down spouts or tubes and floats to maintain the level of molten metal in the molds while also providing molten metal to the molds.

These different casting technologies have different advantages and disadvantages and produce various billet qualities, but no one of which is required to practice this invention. Therefore any versatile or universal mold table system must be designed to support any of these different technologies and systems.

The metal distribution system is also an important part of the casting system. In the two technology examples given, the hot top distribution trough sits atop the mold table while the conventional pouring trough is suspended above the mold table to distribute the molten metal to the molds.

Mold tables come in all sizes and configurations because there are numerous and differently sized and configured casting pits over which mold table are placed. The needs and requirements for a mold table to fit a particular application therefore depends on numerous factors, some of which include the dimensions of the casting pit, the location(s) of the sources of water and the practices of the entity operating the pit.

The upper side of the typical mold table operatively connects to, or interacts with, the metal distribution system. The typical mold table also operatively connects to the molds which it houses. Precision in the location of the operative connections is therefore critical to proper interconnection of the mold table and to the resulting quality of the billets and ingots being cast.

It has been the longstanding practice to manufacture mold tables using a process which requires numerous different and discrete steps, i.e. the metal plate construction method. It has been long recognized that the metal plate construction method involves too many steps and requires too much time, money and labor. The metal plate construction method is a very time consuming and expensive process wherein the manufacturer starts with two metal plates which are the approximate dimensions of the desired mold table. Metallic tubes are interconnected to form a water frame, which is then placed between and attached to each of the two metal plates.

Once the two metal plates are attached to and around the water frame, the multi-step custom manufacturing process begins. The mold cavities and other requisite holes are drilled in each metal plate. Custom design work and engineering is generally necessary to obtain maximum mold density and sizing and substantial custom machining and fitting is required to construct the mold table. This general process is known by those of ordinary skill in the art.

The need for a simplified mold table system which minimizes the amount of custom design and engineering has been long recognized, but has not been adequately fulfilled by prior known machinery or methods. Fulfilling this need will result in substantial cost savings and reduced delivery time in the manufacture of mold tables.

In accomplishing these objectives through the use of a modular construction and frame system, this invention achieves the advantages of lower costs, lower manufacturing time, minimization of custom engineering and minimization of custom manufacture.

Aluminum and other non-ferrous metal manufacturers strive to obtain the highest mold density, i.e. to simultaneously cast the maximum number of billets for a given mold table size or pit. Maximizing mold density depends upon the size of the billets desired, the number of billets desired, the type of billet being cast, and different combinations thereof. Designing to maximize density for a given mold table application therefore generally involves substantial custom design work under the conventional metal plate construction method.

The way this invention uses pre-designed and standard components allows mold modules to be designed and optimized once for many of the design objectives, mold density being one example. The same module, once designed, can be used in many different applications without a need to redesign the primary elements. In accomplishing the objectives of simplifying and standardizing mold tables and their manufacture, this invention has the additional advantage of achieving maximum mold density for a given casting pit or mold table, while minimizing the custom engineering required by conventional systems.

It is also an objective of this invention to provide an improved water or coolant distribution system which effectively works in combination with the water passageway in the longitudinal and transverse headers and the modules. This invention accomplishes this objective by providing a water distribution system which includes a relatively easy operative connection between the coolant passageways in the longitudinal headers and an internal cavity within the mold modules.

The operative coolant connection between the coolant passageway in the longitudinal header and the internal cavity of the mold module is made during the process of attaching the modules to the longitudinal headers. Making the operative connection generally involves drilling a hole in the top of the longitudinal header to the coolant passageway and drilling a corresponding hole up through the lower surface of the overlap section of the mold module. The two corresponding holes are aligned and sealed during the attachment of the mold module to the longitudinal headers.

The water distribution system provided by this invention supplies water to the mold modules and to the molds without requiring as much plumbing and more complex and custom connections heretofore used in the industry. The modular system provided by this invention does not require that the metal plates first be attached to the frame and then manufactured sequentially as one unit. Instead, this invention allows the simultaneous manufacture, assembly and drilling of the longitudinal and transverse headers separate and apart from the manufacture of the mold modules. The mold modules can be manufactured by casting and then machining to specification. Once independently or simultaneously manufactured, the various components can then be assembled. The numerous advantages and consequent cost and time savings from this invention are therefore obvious and easily recognized by those of ordinary skill in the art.

The currently available mold tables include an oil plumbing system to provide oil to the molds for casting. Substantial custom design and custom manufacture of the plumbing is required to provide oil to the end of each of the rows of molds and then again to provide oil from the end of the row to each individual mold. Further, a substantial amount of plumbing and piping hardware is required to accomplish this. The custom design and manufacture currently practiced in the industry is much more time consuming, non-uniform and costly than it need be.

This invention accomplishes the objective of minimizing the amount of custom design and manufacture of the oil distribution system by providing an oil passageway through the extruded longitudinal headers. By placing an oil passageway in the longitudinal header, oil is supplied and provided along the entire length of the longitudinal headers, i.e. to the end of each row of mold modules. The oil passageway in the longitudinal header can be easily tapped into by partially drilling through the top of the longitudinal header to the passageway. A corresponding hole can also be drilled through the end of the mold module to form a passageway to the top of the mold module where the oil injector manifold can be located. An 0-ring can be placed between the mold module and the top of the longitudinal header to seal the interconnection.

The oil passageway along the length of the longitudinal header can be formed as part of the extrusion process if the longitudinal headers are extruded.

Once the oil passageway in the longitudinal headers are tapped into, standard plumbing can be utilized to provide the oil to each of the molds in the adjacent mold module(s). However, as distinguished from prior practices, plumbing is only required from the longitudinal headers to the mold and not all along the longitudinal headers, as previously required.

Providing the oil through a passageway in the longitudinal headers has the advantages of: reducing the custom design and manufacture of the plumbing that would otherwise be needed; reducing the time and hardware to manufacture and assemble a mold table; and simplifying the manufacture and assembly of the mold tables.

The gas distribution system in conventional mold tables has substantially the same problems that oil distribution systems have. This invention accomplishes the same objectives in substantially the same way with substantially the same advantages as for the oil distribution system by also supplying and providing gas through a passageway along the length of the longitudinal headers.

It should be noted that both the oil and the gas distribution systems are options.

There is also a need to screen larger particles from the coolant before the coolant is utilized by the mold. This screening has heretofore been accomplished by individual screens located at each mold, which requires unnecessary additional time to clean each of the several screens. This invention utilizes a centralized screen located in the coolant passageway in the longitudinal and/or transverse headers, which has the advantage of easier access and less maintenance time.

The forenamed recognized needs have not heretofore been sufficiently fulfilled by existing mold table systems.

BRIEF DESCRIPTION OF THE DRAWINGS

Preferred embodiments of the invention are described below with reference to the accompanying drawings, which are briefly described below.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Many of the fastening, connection, process and other means and components utilized in this invention are widely known and used in the field of the invention described, and their exact nature or type is not necessary for an understanding and use of the invention by a person skilled in the art or science, and they will not therefore be discussed in significant detail. Furthermore, the various components shown or described herein for any specific application of this invention can be varied or altered as anticipated by this invention and the practice of a specific application of any element may already be widely known or used in the art or by persons skilled in the art or science and each will not therefore be discussed in significant detail.

Although water is the preferred coolant for use with the invention and in the industry, any other suitable liquid coolant may be used within the contemplation of this invention.

It is to be understood that this mold table system applies to and can be utilized in connection with various types of metal pour technologies and configurations, including but not limited to both hot top technology and conventional pour technology.

In a typical hot top mold table there are troughs made of a insulating refractory material which is used to receive the molten metal in its channels and provide a trough through which the molten metal is supplied to each of the molds. There are a number of different hot top refractory systems and conventional pour technologies that will work in conjunction with this invention, none of which are specifically required to practice this invention.

The mold module 43 therefore must be able to receive molten metal from a source of molten metal, whatever the particular type of source is, whether it be hot top pour technology or a conventional pour apparatus. The mold cavities 44 in the mold module 43 must therefore be oriented in fluid or molten metal receiving position relative to the source of molten metal. For conventional pour technology, the mold may be operatively attached to the module 43 at a level above the top surface of the module 43.

The mold table system of this invention is a apparatus and process which provides for a mold table and the construction and use thereof, wherein the frame and the mold modules are standardized and assembled like building blocks instead of the traditional custom design and manufacturing that has long prevailed in the industry. The invention applies to mold tables of all sizes and configurations wherein the system described herein is practiced. This invention covers frames and mold modules regardless of the specific configuration, numbers or combinations thereof utilized.

Figure 1:
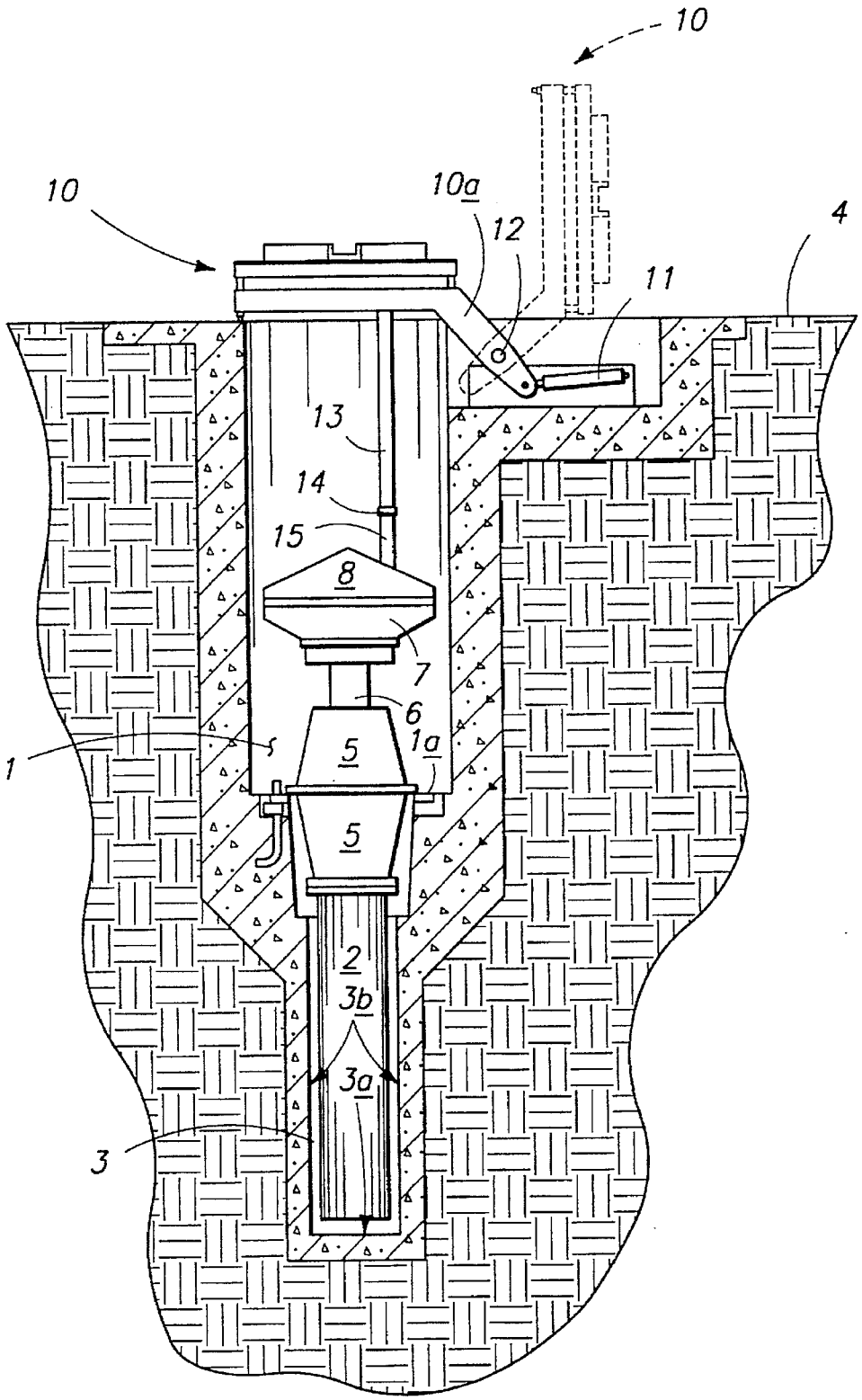
FIG. 1 is an elevation view of a typical casting pit, caisson and aluminum casting apparatus.
Figure 2:
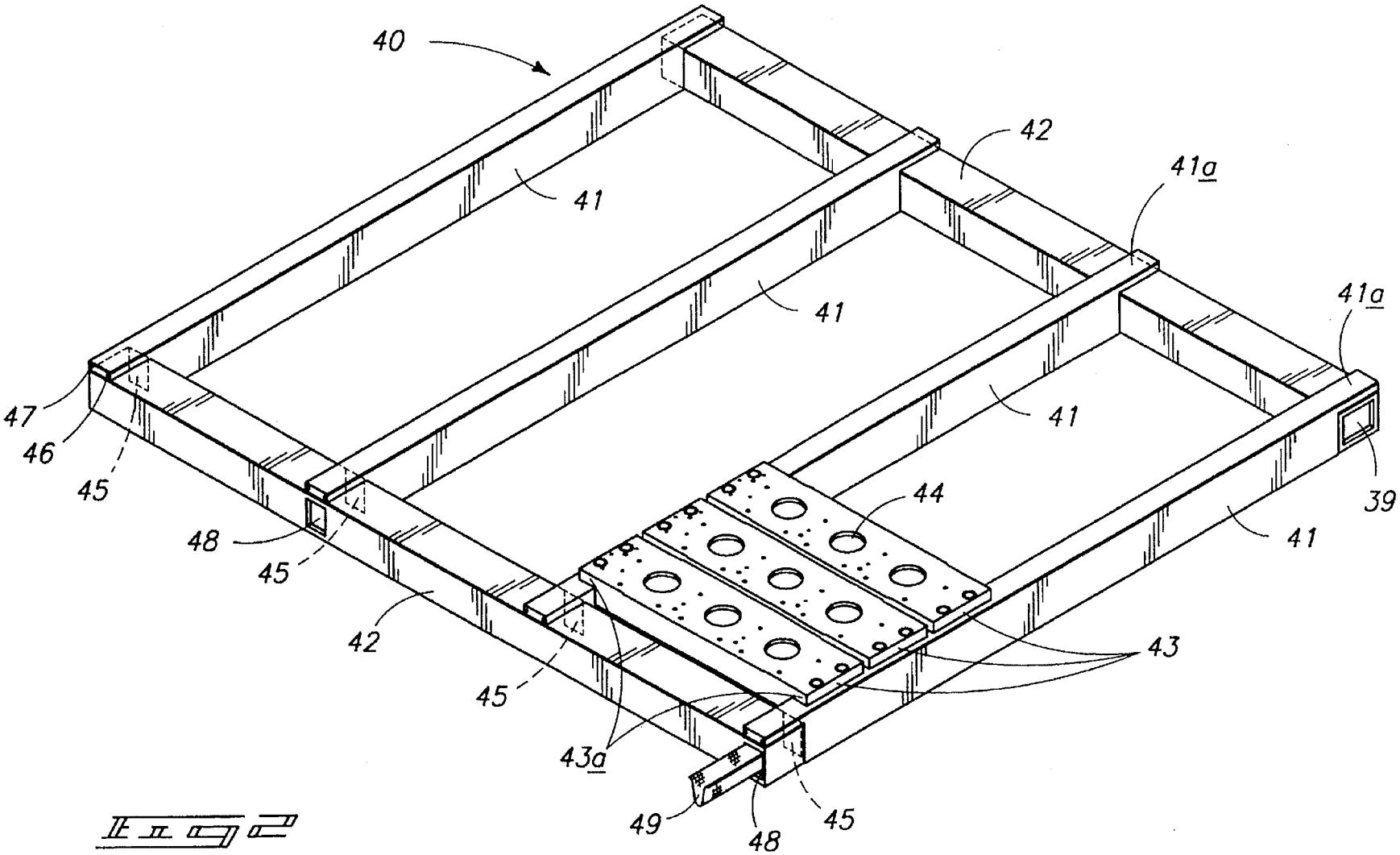
FIG. 2 is a perspective view of an application of the invention, including a frame with three strand mold modules.

FIG. 2 shows one application of the frame 40 of a mold table with three mold modules 43 thereon. In FIG. 2, four longitudinal headers 41 are shown operatively connected to two transverse headers 42. Although not necessary to practice the invention, the preferred longitudinal headers 41 include header overlap sections 41*a* on the longitudinal headers 41 to allow easier and more consistent vertical alignment in the assembly of the frame 40.

The longitudinal headers 41 include a coolant passageway 45 which may be operatively connected with a corresponding coolant passageway 39 in the transverse headers 42. In constructing any given frame of longitudinal headers 41 and transverse headers 42, the coolant passageways 45 in any given longitudinal header 41 can be operatively connected to the coolant passageway 39 in a transverse header 42, to allow coolant to flow between the two passageways. Furthermore there can be one or more inlet sources of coolant to the frame 40, depending on the specific application of the invention.

Preferably, all the longitudinal headers 41 and transverse headers 42 in any given application of the frame 40 will have internal coolant passageways and the coolant passageways will be operatively connected at each location where a longitudinal header 41 is connected to a transverse header 42. The coolant passageway system on the headers can have one or more access ports 48 which are covered and sealed during casting, but which provide access to the passageways for various reasons.

The gas distribution system and the oil distribution system provided by this invention are optional items which can be provided with the mold table. As background, examples of the different types of gas which are utilized during the casting process are nitrogen-oxygen, argon-oxygen mixtures, dry air or others. The different types of synthetic and organic oils used are also well known in the industry and depend on the particular mold technology being utilized.

Coolant is supplied to the coolant passageways through one or more inlets, which are typically located on the bottom side of the frame and which are known to the art.

It is desirable to screen the coolant provided to each of the molds to remove contaminants that may become trapped therein. As illustrated more fully in FIG. 2, this invention provides an elongated coolant screen 49 which can be inserted into the coolant passageway 45 in a longitudinal header 41 or in a transverse header 42, or both, to provide a more centralized and efficient screen which requires less maintenance time than screens heretofore utilized.

The shape of the coolant screen 49 can be varied within the contemplation of this invention. The coolant screen 49 is generally constructed of metallic mesh well known in the art and can be bent or formed to whatever shape or configuration is desired. The coolant screen 49 can extend partially or entirely through the length of a coolant passageway.

It is preferable to have an opening at the end of the longitudinal or transverse headers which contain coolant screens 49, and for example, depending on whether the transverse header abuts the end of the longitudinal header 41, the opening may need to be in the transverse header for coolant screens 49 placed longitudinally in the longitudinal headers 41.

Many casting table applications require that in addition to a casting coolant, either oil or gas, or both, be delivered to each of the molds during the casting process. It is preferred that the longitudinal headers 41 include integrated oil distribution passageways, oil passageway 46, along the entire length thereof. It is also preferred that the longitudinal headers 41 include integrated gas distribution passageways, gas passageway 47, along the entire length thereof.

Figure 7:
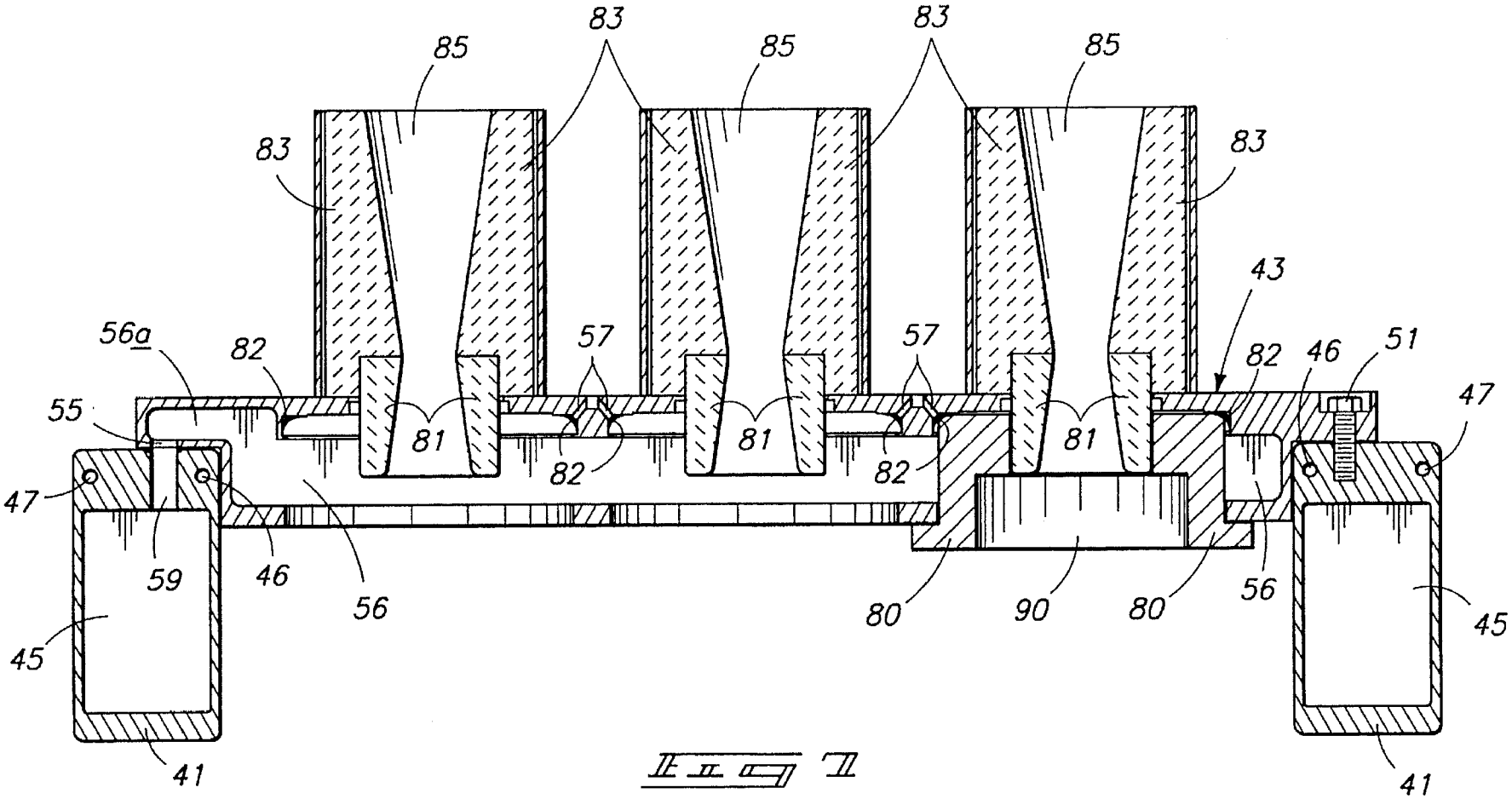
FIG. 7 is section view 7—7 from FIG. 6.

While the longitudinal headers 41 can be made a number of different ways using a number of different materials, it is preferred that they be extruded such that the desired passageways for coolant, oil and gas are formed internally along the entire length of the longitudinal header 41 during the extrusion process. FIG. 7 better illustrates a cross section of a longitudinal header 41 which can be used to practice this invention, including the coolant passageway 45, the oil passageway 46 and the gas passageway 47.

The three mold modules 43 shown in FIG. 2 also include module mounting overlaps 43*a* which extend over the top surface of the longitudinal headers 41. The module mounting overlaps 43*a* allow the modules 43 to be consistently located and placed atop the longitudinal headers 41. The module overlap portion also facilitates the easy and consistent interconnection of the longitudinal headers 41 to the mold modules 43 and the ability to attach other equipment to the longitudinal headers 41.

Figure 3:
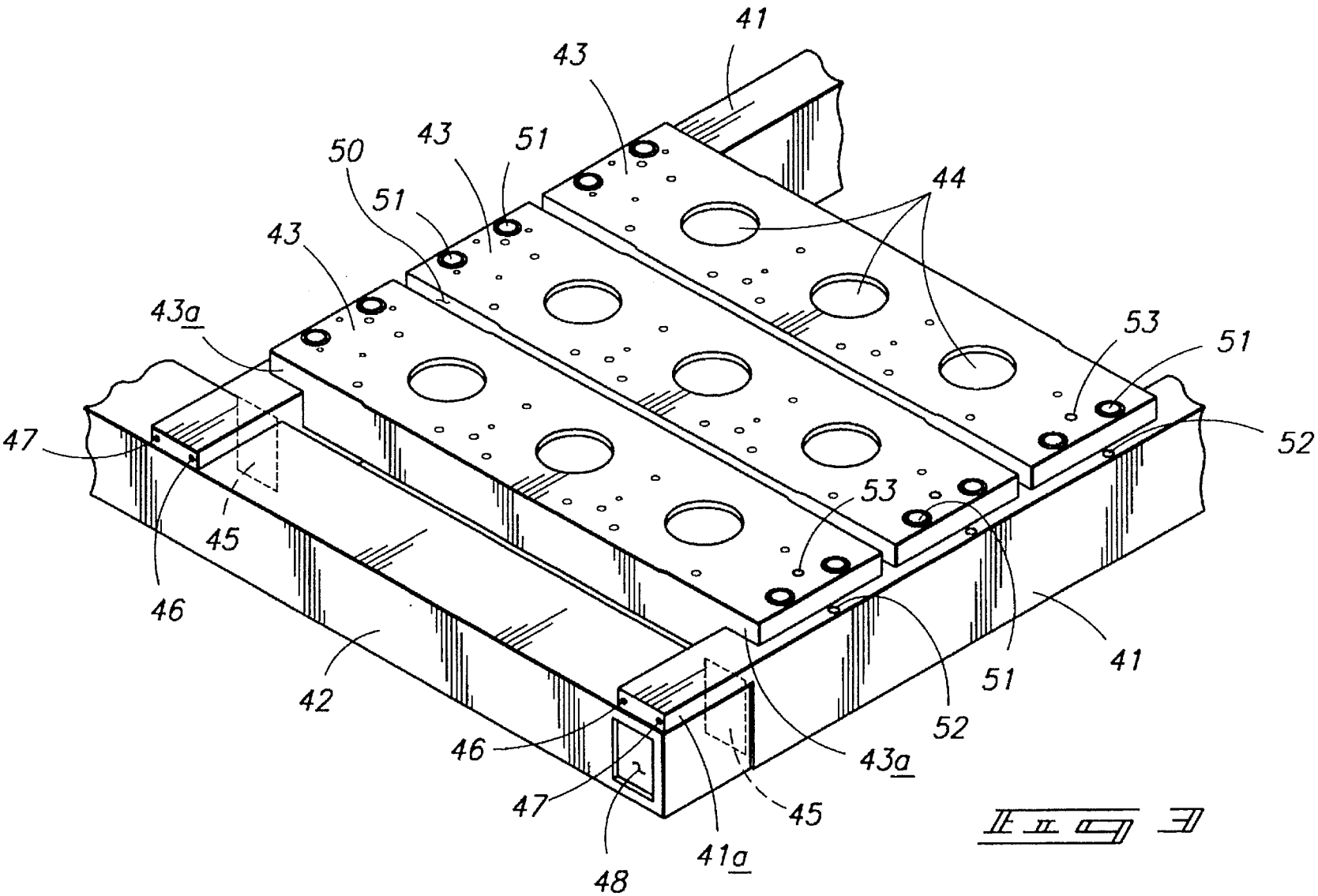
FIG. 3 is a perspective view of the application of the invention shown in FIG. 2, including a frame with three mold modules.

FIG. 3 shows a closer view of the three mold modules 43 on the frame 40, as also shown in FIG. 2, as well as the mold cavities 44.

FIG. 3 shows an offset 50 on both sides of both ends of the mold module 43, which results in a sufficient gap between adjacent modules that gas, oil and other piping can be directed through the gap.

An example of the need to route piping through the gap resulting from the offsets 50 is shown in the mold table configuration shown in FIG. 2 wherein there are three separate rows of modules. Since it is desirable, safer and much more convenient to control the supply of oil and gas from the far sides of the mold table, modules placed in the center row of the frame 40 in FIG. 2 would preferably receive oil through piping originating from one or both sides of the far side longitudinal headers 41. The gaps created by the offsets 50 can be used to route piping to thereby provide oil and gas to the middle row.

FIG. 3 also illustrates the bolts 51 used to secure each end of the mold modules to the longitudinal headers 41. Oil holes 53 are drilled through the end of the mold module and through a portion of the longitudinal headers 41 to access the oil passageway 46 in the longitudinal header 41.

Gas holes 52 are drilled through a portion of the top of the longitudinal headers 41 to access the gas passageway 47 in the longitudinal header 41.

Figure 4:
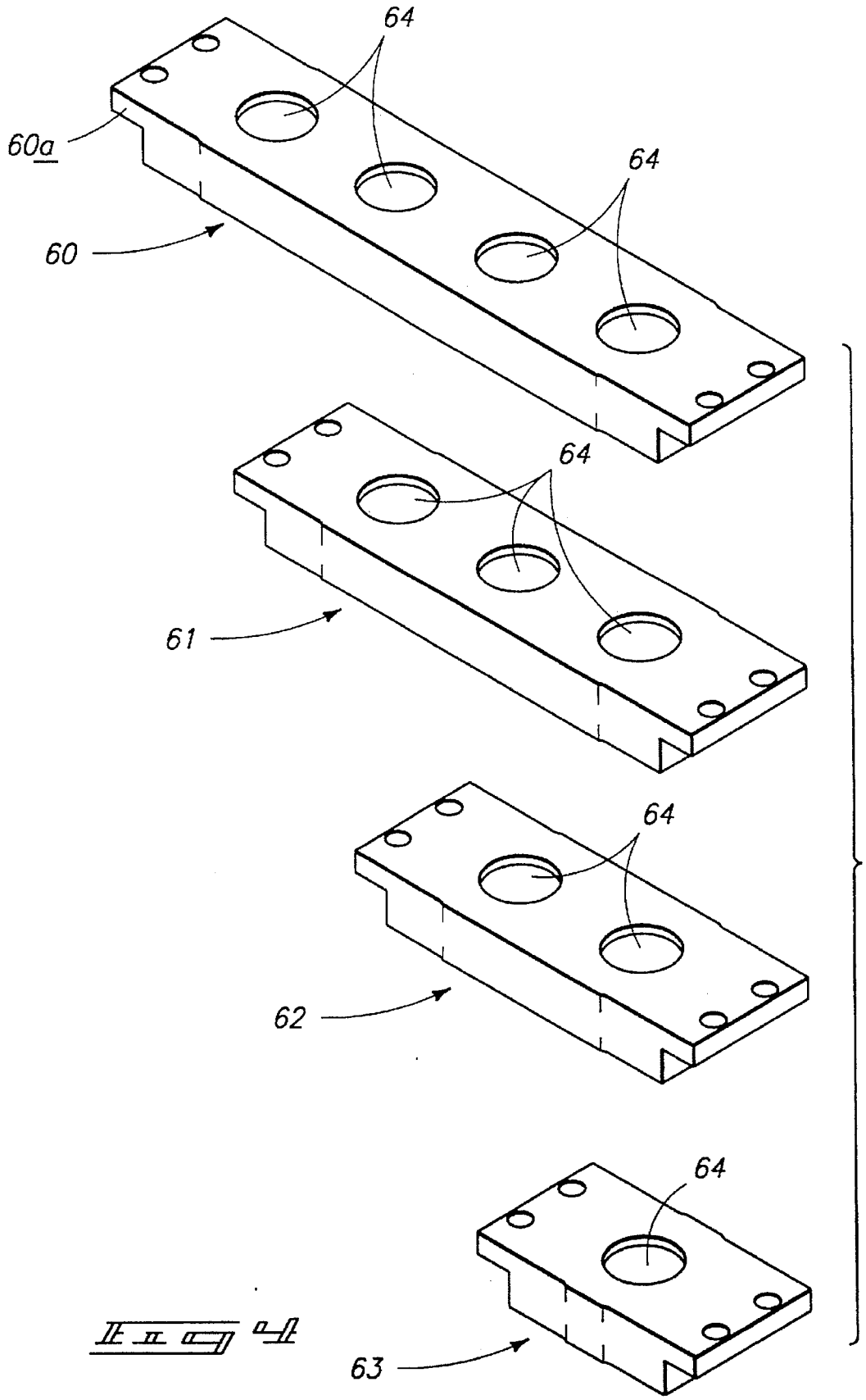
FIG. 4 is a perspective view of different examples of mold modules which can be utilized with a frame spaced to receive the particular module, illustrating modules with various numbers of strands.

FIG. 4 illustrates examples of mold modules which can form the building blocks of a mold table when placed upon a given application of a frame: mold module 60 is a four strand module as it includes four mold cavities 64, i.e. a four billet module wherein the mold cavities 64 and consequently the billet size can be a variety of different sizes; mold module 61 is a three strand module as it includes three mold cavities 64; mold module 62 is a two strand module as it includes two mold cavities; and mold module 63 is a one strand module as it includes only one mold cavity 64.

Mold module 60 by way of illustration, shows the mounting overlap 60*a* which is the portion of the mold module 60 which is placed upon the longitudinal headers 41.

The variety of sizes of mold modules with the varying numbers of mold cavities 64 contained therein can be engineered one time and then utilized repetitively for the many different applications by placing them on the frame designed for the application.

Figure 5:
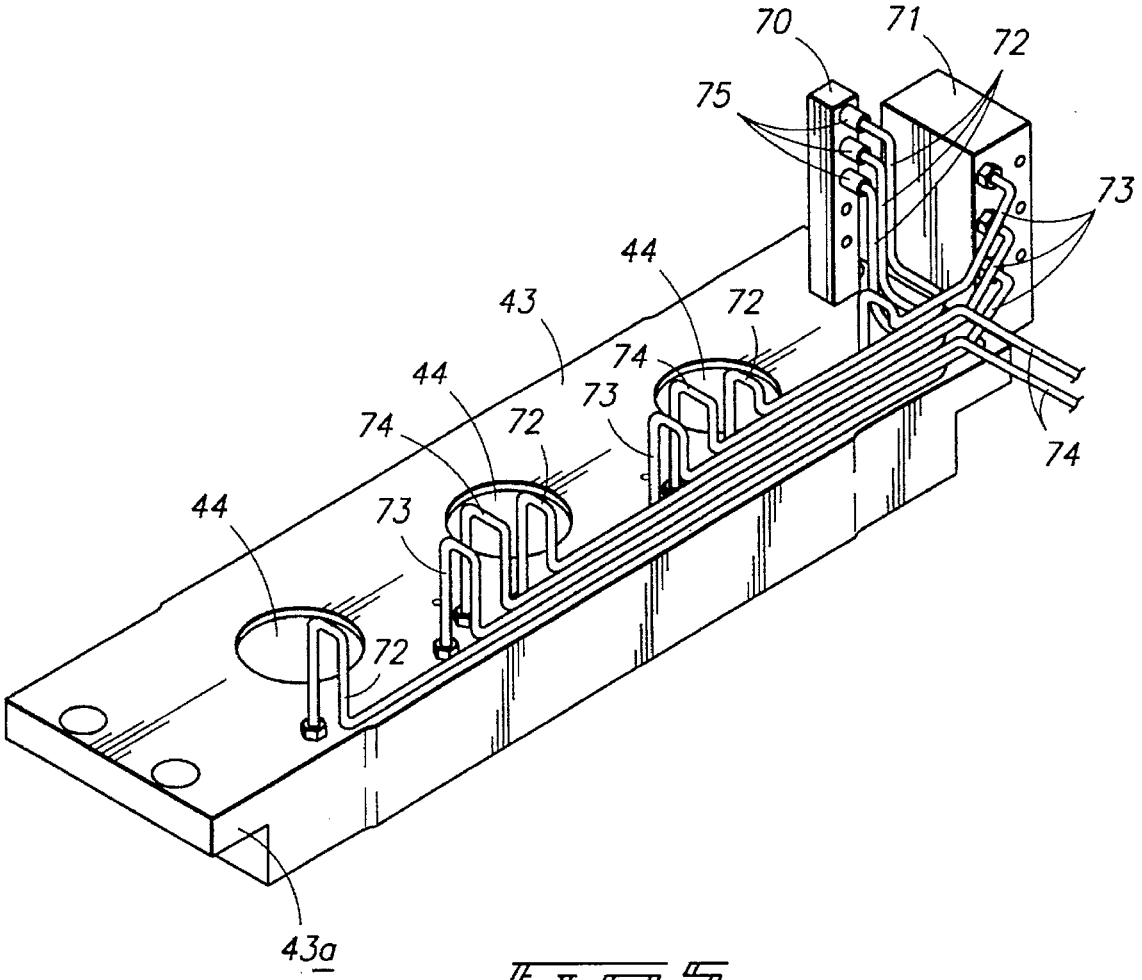
FIG. 5 is a perspective view of a mold module, including the plumbing to provide oil and gas to the cast molds.

FIG. 5 generally shows a mold module with oil and gas piping and components which operatively connect the oil distribution system and the gas distribution system to the individual molds. The oil and the gas is received by any given mold module through the oil passageway 46 and the gas passageway 47 respectively, along the length of a longitudinal header 41. The oil passageway 46 and the gas passageway 47 provide a pressurized supply of oil and gas respectively the entire length of the longitudinal headers 41.

The oil passageways can be tapped to receive oil by drilling holes through both the mounting overlap portion 43*a* of the mold module 43 and that portion of the longitudinal header 41 required to access the oil passageway. An O-ring or other suitable sealant can be utilized between the metal to metal connection resulting between the module 43 and the longitudinal header 41, to maintain a sealed passageway through which the oil can pass to the top of the overlap portion 43*a* of the mold module 43.

The gas passageway 47 can be tapped to receive gas by drilling holes through that portion of the longitudinal header 41 required to access the gas passageway 47. An O-ring or other suitable sealant can be utilized between the metal to metal connection resulting between the module 43 and the longitudinal header 41, to maintain a sealed passageway through which the gas can pass to the top of the longitudinal header 41.

A number of known suitable devices can be utilized to receive and further distribute the oil as it is received from the oil passageway 46 in the longitudinal header 41. An oil injection manifold 70 is shown in FIG. 5, with oil injectors 75 and oil piping 72. Conventional and known oil injection manifolds 70, oil injectors 75 and oil piping 73 can then utilized to distribute the oil as desired to each of the molds.

A number of known suitable devices can also be utilized to receive and further distribute the gas as it is received from the gas passageway 46 in the longitudinal header 41. A gas manifold 71 is shown, with gas piping 73 also shown, both of which can utilize conventional and known components.

Since the oil and the gas can be provided at standardized locations in the longitudinal headers 41, the oil piping 73 and the gas piping 72 can be pre-designed and pre-bent and mass produced to match the standards, instead of being custom manufactured and fit to interact with previously utilized master oil and gas supply lines. The oil passageway 46 and the gas passageway 47 have replaced the master oil and gas supply lines which were previously utilized to provide oil and gas to each set or row of molds.

The oil entry can be the end of the oil passageway 46, which is where the oil passageway 46 meets the end of the longitudinal header 41. Likewise, the gas entry can be the end of the gas passageway 47, which is where the gas passageway 47 meets the end of the longitudinal header 41.

The system as shown in FIG. 5, with the piping above the top level of the mold module 43 or mold table is best suited to operate in combination with a hot top pour technology system because refractory and the like can be placed around it. In the applications of this invention which are better suited to conventional pour technologies however, the plumbing is preferably located below the top level of the mold modules 43 and the mold 80 may be mounted above the top level or surface of the mold modules 43. In either case with this invention, the plumbing is standardized and simplified so that the lines can be precut and bent in advance of assembly.

The oil injectors 75 are of a standard design and have been incorporated over the outer mounting overlap portion 43*a* of each mold module 43. The gas flow control system can be any one of a number of known products, including a stackable gas manifold that uses a needle valve to regulate the gas flow.

To insure that the molds are properly and safely installed into each mold module, independent drain tubes 74 are connected between the primary and secondary mold seal of each mold and routed to a side longitudinal header 41 so that if water is leaking into the tube, it is easily visible to an operator from the side of the mold table, who can then take immediate corrective action. If for any reason the primary O-ring leaks, this leak can be detected from the outside of the casting table.

Figure 6:
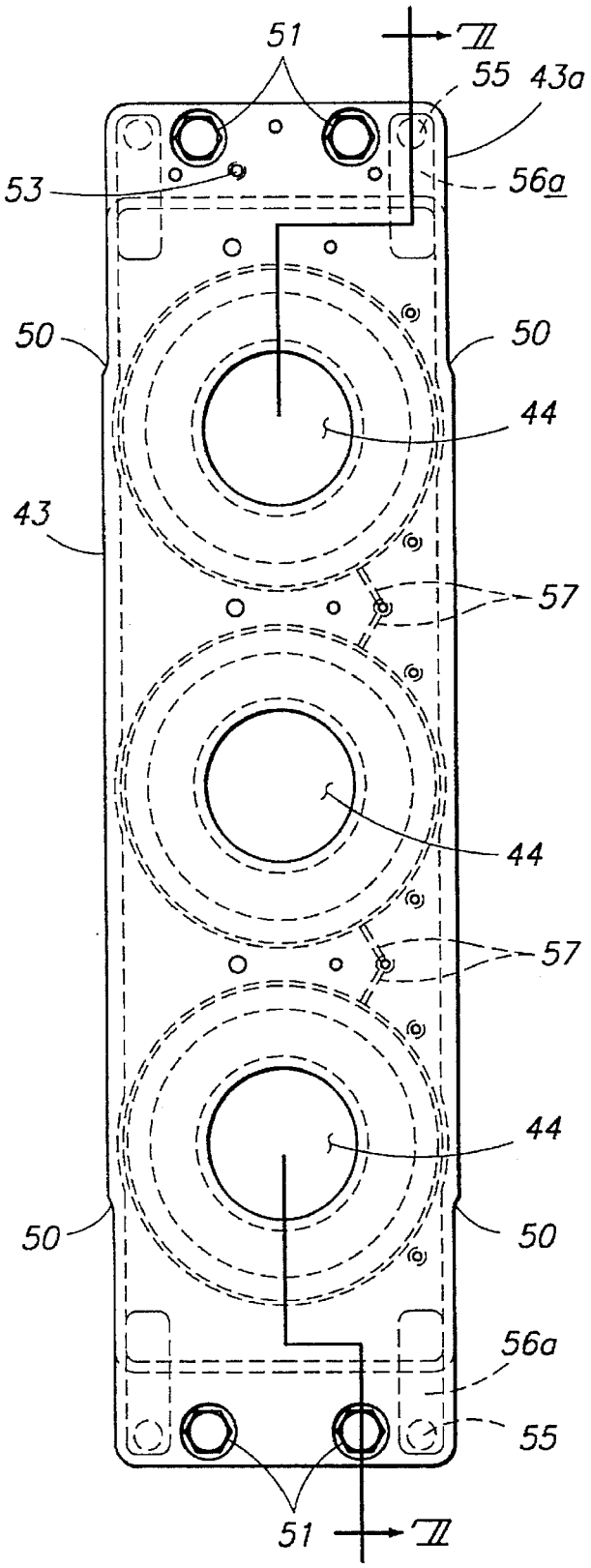
FIG. 6 is a top view of one example of a mold module which can be utilized in connection with this invention.

FIG. 6 and FIG. 7 further show the leak detection holes 57 to which the drain tubes 74 are operatively connected. The leak detection holes 57 tap into the cavity between the mold 80 and the bottom of the mold module 43, as illustrated in FIG. 7. Silicon seal 82, which is also shown, is described more fully hereinafter.

FIG. 6 is a top view of a three strand mold module 43 which can be utilized in this invention. The mold modules are preferably made by casting.

FIG. 6 shows the offsets 50 on both sides of the first end and the second end of the mold module 43, as more fully described above. Bolts 51 allow the mold module to be attached to the longitudinal headers 41. Oil hole 53 can be drilled to correspond to and tap into the oil passageway 46 in the longitudinal header 41 and provides for the exit of the oil from the longitudinal header 41. Further drilling oil hole 53 through the mold module creates a further oil exit passageway to provide oil at the top of the mold module for operative connection with an oil injector manifold 70.

FIG. 7 is section 7—7 from FIG. 6 and illustrates a section view of the mold modules and shows by example how the mold module 43 may interact or combine with and connect to hot top pour technology and refractory, as well as how it may interact with a conventional casting mold 80.

The internal cavity 56 of the mold module 43 has an extended portion 56*a* which can be cast into the module and which facilitates the operative connection between the module internal cavity 56 and the coolant passageway 45 in the longitudinal header 41. Coolant hole 55 can be drilled to correspond to a similar hole through a portion of the longitudinal header 41, hole 59, and to the coolant passageway 45 in the longitudinal header 41. An O-ring can be placed between the mold module 43 and the top of the longitudinal header 41 to seal the interconnection. The extended portion 56*a* of the module internal cavity 56 is further illustrated in FIG. 7

Mold cavity 44 can receive whatever components are necessary to facilitate pouring of the molten metal into the molds and will depend on the specific pour technology that this invention is being used in combination with.

FIG. 7 illustrates an example of an application of the mold module 43 and the formation of the module internal cavity 56 when the module is combined with a typical casting mold 80. The lower open portion 90 of the mold 80 operatively connects to, centers to and interacts with the starting block 14 at the start of the casting process. The starting blocks 14 for each mold are raised up into the open portion 90 of the mold before casting and then slowly lowered from the molds during the casting process thereby forming billets for example.

An example of the inter-connection or relative position between the mold 80 and the mold module 43 is shown in FIG. 7. A silicon seal 82 is utilized to seal between the mold 80 and the mold module 43. The leak detection holes 57 are drilled to locations behind the silicon seals to detect leaks at those locations and water leaking through at any pressure travels through leak detection holes 57 through drain tubes 74 for easy visual inspection by an operator.

The module internal cavity 56 receives coolant in one or more of its extended portions 56*a* through coolant hole 55. The coolant is then utilized during the casting process to solidify the molten metal into billets.

In the example of hot top pour technology shown in FIG. 7, thimble 81 and refractory 83 are utilized to facility the pouring of molten metal into the molds. Refractory pour hole 85 is generally shaped to facilitate the movement of molten metal through the pour hole and into the mold 80.

It must be kept in mind that the mold module needs to able to receive molten metal from all types of pour technology configurations, i.e. sources of molten metal, including but not limited to hot top and conventional pour technologies.

For hot top technologies, the refractory and other sources of molten metal for the mold module may be attached to the top side of the mold module 43. However for other conventional pour technologies interacting with the modules, the mold 80 may be mounted on the top surface of the mold module with no physical connection with the source of molten metal.

The mold module 43 merely needs to be able to operatively connect to a mold 80, whether the mold 80 is operatively connected from the bottom or the top of the mold module. No particular type of mold 80 is required to practice this invention.

Aluminum is typically poured into the vertical casting molds by molten metal distribution launders, such as is set forth in U.S. Pat. No. 5,316,071, entitled "Molten Metal Distribution Launder", which is incorporated herein by this reference.

During the casting process and for control purposes in vertical aluminum casting assemblies, molten metal level sensors and controllers are typically used to control and monitor the casting process, an example of which is set forth in U.S. Pat. No. 5,339,885, which is incorporated herein by this reference.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A modular non-ferrous metal casting mold table comprising:

a. a frame, which is comprised of i. a plurality of longitudinal headers, at least one of which has a coolant passageway; and ii. at least one transverse header connected to the longitudinal headers; and b. a plurality of self-contained, one piece mold modules i. having a first end and a second end, the first end and the second end being attached to longitudinal headers, and ii. having at least one mold cavity.

2. A modular non-ferrous metal casting mold table as recited in claim 1, and in which at least one of the transverse headers includes a coolant passageway.

3. A modular non-ferrous metal casting mold table as recited in claim 2, in which at least one of the coolant passageways in the transverse headers is operatively connected to the coolant passageway in the longitudinal header, forming a coolant passageway between the transverse header and longitudinal header.

4. A modular non-ferrous metal casting mold table as recited in claim 1, and which further comprises:

a. an oil delivery system, wherein the longitudinal headers are further comprised of:

i. a longitudinally oriented oil passageway within the longitudinal header;

ii. an oil entry to the oil passageway; and iii. a plurality of oil exits from the oil passageway.

5. A modular non-ferrous metal casting mold table as recited in claim 1, and which further comprises:

a. a gas delivery system, wherein the longitudinal headers are further comprised of:

i. a longitudinally oriented gas passageway within the longitudinal header;

ii. a gas entry to the gas passageway; and iii. a plurality of gas exits from the gas passageway.

6. A modular non-ferrous metal casting mold table as recited in claim 1, and which further comprises:

a. an oil delivery system, wherein the longitudinal headers are further comprised of:

i. a longitudinally oriented oil passageway within the longitudinal header;

ii. an oil entry to the oil passageway;

iii. a plurality of oil exits from the oil passageway; and b. a gas delivery system, wherein the longitudinal headers still are further comprised of:

i. a longitudinally oriented gas passageway within the longitudinal header;

ii. a gas entry to the gas passageway; and iii. a plurality of gas exits from the gas passageway.

7. A modular non-ferrous metal casting mold table as recited in claim 1, and which further comprises:

a. an elongated coolant screen longitudinally inset within a coolant passageway in a longitudinal header.

8. A modular non-ferrous metal casting mold table as recited in claim 1, and which further comprises:

a. an elongated coolant screen longitudinally inset within a coolant passageway in a transverse header.

9. A modular non-ferrous metal casting mold table as recited in claim 1, and in which the mold modules are operatively connected to at least one mold.

10. A modular non-ferrous metal casting mold table as recited in claim 1, and in which the mold modules are oriented in molten metal receiving relation to a source of molten metal.

11. A non-ferrous metal casting mold module, comprising:

a. a self-contained, one-piece mold module body:

i. having a first end and a second end, the first end and the second end being disposed to be attached to longitudinal headers of a mold table frame;

ii. being oriented in attachable disposition to a mold; and iii. having at least one mold cavity, said mold cavities being oriented in molten metal receiving relation to a source of molten metal.

12. A non-ferrous metal casting mold module as recited in claim 11, and in which the mold module body further comprises:

a. an inner cavity oriented in fluid coolant receiving relation to a source of coolant.

13. An oil delivery system in a non-ferrous metal casting mold table having at least one longitudinal header, and which comprises:

a. a longitudinally oriented oil passageway within at least one of the longitudinal headers of the mold table;

b. an oil entry to the oil passageway; and c. a plurality of oil exits from the oil passageway.

14. A gas delivery system in a non-ferrous metal casting mold table having at least one longitudinal header for use in combination with the oil delivery system recited in claim 13, and in which the gas delivery system comprises:

a. a longitudinally oriented gas passageway within at least one of the longitudinal headers of the mold table;

b. a gas entry to the gas passageway; and c. a plurality of gas exits from the gas passageway.

15. A gas delivery system in a non-ferrous metal casting mold table having at least one longitudinal header, and which comprises:

a. a longitudinally oriented gas passageway within at least one of the longitudinal headers of the mold table;

b. a gas entry to the gas passageway; and c. a plurality of gas exits from the gas passageway.

16. A coolant screening system in a non-ferrous metal casting mold table having at least one longitudinal header, and which comprises:

a. at least one coolant passageway in at least one of the longitudinal headers; and b. an elongated coolant screen longitudinally inset within the coolant passageway in the longitudinal header.

17. A coolant screening system in a non-ferrous metal casting mold table having at least one transverse header, and which comprises:

a. at least one coolant passageway in at least one of the transverse headers; and b. an elongated coolant screen longitudinally inset within the coolant passageway in the transverse header.

18. A process for the assembly of a modular non-ferrous metal casting mold table, comprising the following steps:

a. providing a plurality of longitudinal headers, at least one of which has a coolant passageway;

b. providing at least one transverse header;

c. providing a plurality of self-contained, one-piece mold modules, each having a first end and a second end, i. wherein both the first end and the second end of each mold module are attachable to longitudinal headers, and ii. wherein each mold module is comprised of at least one mold cavity;

d. arranging and connecting the longitudinal headers and the transverse headers to form a frame; and e. attaching the first end and the second end of the mold modules to the longitudinal headers.

19. A process for the assembly of a modular non-ferrous metal casting mold table as recited in claim 18, and further comprising the following steps:

a. providing at least one of the transverse headers with a coolant passageway; and b. during the step of arranging and connecting the longitudinal headers and the transverse headers to form a frame, further operatively connecting at least one of the coolant passageways in transverse headers to the coolant passageway in the longitudinal header, thereby forming a coolant passageway between the transverse header and longitudinal header.

* * * * *